US008418606B2

(12) United States Patent
Onishi et al.

(10) Patent No.: US 8,418,606 B2
(45) Date of Patent: Apr. 16, 2013

(54) PRESS ANGLE CONTROL DEVICE, PRESS MACHINE FACILITY, AND PRESS ANGLE CONTROL METHOD

(75) Inventors: Dai Onishi, Tokyo (JP); Takeshi Takahashi, Tokyo (JP)

(73) Assignee: IHI Corporation, Tokyo (JP)

( * ) Notice: Subject to any disclaimer, the term of this patent is extended or adjusted under 35 U.S.C. 154(b) by 448 days.

(21) Appl. No.: 12/680,169

(22) PCT Filed: Aug. 25, 2008

(86) PCT No.: PCT/JP2008/065086

§ 371 (c)(1),
(2), (4) Date: Mar. 25, 2010

(87) PCT Pub. No.: WO2009/041199

PCT Pub. Date: Apr. 2, 2009

(65) Prior Publication Data

US 2010/0192787 A1 Aug. 5, 2010

(30) Foreign Application Priority Data

Sep. 27, 2007 (JP) ..... 2007-251297

(51) Int. Cl.
*B30B 13/00* (2006.01)
*B30B 15/14* (2006.01)

(52) U.S. Cl.
USPC ..... 100/35; 100/46; 100/207; 72/20.1; 72/443

(58) Field of Classification Search ..... 100/35, 100/43, 46, 48, 273, 282, 207; 72/20.1, 21.2, 72/443, 21.1
See application file for complete search history.

(56) References Cited

U.S. PATENT DOCUMENTS

| | | | | |
|---|---|---|---|---|
| 3,991,350 | A | 11/1976 | Miyagoshi | |
| 5,339,665 | A * | 8/1994 | Yoshikawa | 72/20.1 |
| 7,574,891 | B2 * | 8/2009 | Futamura et al. | 72/454 |
| 8,047,131 | B2 * | 11/2011 | Onishi et al. | 100/35 |
| 2001/0032550 | A1 * | 10/2001 | Narita | 100/35 |

FOREIGN PATENT DOCUMENTS

| | | | |
|---|---|---|---|
| JP | 59-94800 | | 6/1984 |
| JP | 2000015494 | A | 1/2000 |
| JP | 2001-300793 | A | 10/2001 |
| JP | 2005052855 | A | 3/2005 |
| JP | 3682373 | B2 | 8/2005 |

OTHER PUBLICATIONS

English (machine) translation of the claims and description of of JP 2000-015494 A.*
Office Action dated Aug. 8, 2011 in corresponding Russian Patent Application No. 2010116389.

(Continued)

*Primary Examiner* — Jimmy T Nguyen
(74) *Attorney, Agent, or Firm* — Griffin & Szipl, P.C.

(57) ABSTRACT

A device for reducing the press angle control error caused by press load variation, where the device includes: a reference value output unit that outputs a press angle reference value, a press angle detection unit, a speed command unit, and a driving unit. The press angle detection unit detects a press angle of the corresponding press machine and outputs a press angle detection value. The speed command unit outputs a command speed value of a motor of the corresponding press machine based on the press angle reference value and the press angle detection value. The driving unit controls the motor speed of the corresponding press machine based on the command speed value. The device further includes a correction unit that corrects the press angle reference value or the command speed value so the difference between the press angle reference value and the press angle is within a predetermined range.

7 Claims, 6 Drawing Sheets

OTHER PUBLICATIONS

International Search Report, issued in corresponding application No. PCT/JP2008/065086, completed Oct. 15, 2008, mailed Oct. 28, 2006.

Office Action dated Jan. 13, 2012 in related Taiwanese Patent Application No. 97135429.

* cited by examiner

PRESS ANGLE CONTROL DEVICE, PRESS MACHINE FACILITY, AND PRESS ANGLE CONTROL METHOD

This is a National Phase Application in the United States of International Patent Application No. PCT/JP2008/065086 filed Aug. 25, 2008, which claims priority on Japanese Patent Application No. 2007-251297, filed Sep. 27, 2007. The entire disclosures of the above patent applications are hereby incorporated by reference.

BACKGROUND OF THE INVENTION

1. Field of the Invention

The present invention relates to a press angle control device for a press machine facility provided with a plurality of press machines constituting a press line. Also, the present invention relates to a press machine facility provided with the press angle control device. Also, the present invention relates to a press angle control method for the press machine facility.

2. Description of the Related Art

In the past, a plurality of press machines constitutes a press line in which a plurality of pressing processes is carried out. At this time, a press angle control is carried out so that a press angle difference between the press machines is uniformly maintained or press angles of the press machines are synchronized with each other. A method and a device for performing the press angle control are disclosed in, for example, Japanese Patent No. 3682373 'SYNCHRONOUS CONTROL METHOD OF A PLURALITY OF PRESS MACHINES' and Japanese Laid-open Patent Publication No. 2005-52855 'CONTROLLER FOR CONTINUOUS RUNNING OF MECHANICAL DRIVE TYPE TANDEM PRESS LINE'.

In the press angle control disclosed in Japanese Patent No. 3682373, on the basis of a difference between a press angle of a master press machine as a synchronization reference and a press angle of a slave press machine as a synchronization object, a correction amount of a command speed value input to a motor of the slave press machine is obtained, and the correction amount is added to the command speed value input to the motor, thereby synchronizing the press angles with each other.

In the press angle control disclosed in Japanese Laid-open Patent Publication No. 2005-52855, on the basis of a press angle of an upstream press machine, an angle command signal input to a downstream press machine is corrected, thereby performing a phase difference control in which a phase difference between the upstream press machine and the downstream press machine is uniformly maintained.

However, in the press angle control disclosed in Japanese Patent No. 3682373, since the press angle synchronization control is carried out on the basis of the press angle of the master press machine as a synchronization reference in order to synchronize the press angles with each other, when an actual motor speed of the master press machine varies due to a press load increasing during a pressing process, the variation acts on the slave press machine. As a result, a press angle difference occurs between the press machines, and thus a problem arises in that a large error may occur during the press angle control.

Also, in the press angle control disclosed in Japanese Laid-open Patent Publication No. 2005-52855, since the phase difference control is carried out on the basis of the upstream press machine as a reference in order to uniformly maintain the press angle difference between the plurality of press machines, when an actual motor speed of the upstream press machine varies due to a press load increasing during the pressing process, the variation acts on the downstream press machine. As a result, although it is necessary to uniformly maintain the press angle difference, the press angle difference largely varies, and thus a problem arises in that a large error may occur during the press angle control.

Therefore, an object of the invention is to provide a press angle control device, a press machine facility, and a press angle control method capable of reducing a press angle control error caused by a press load variation and of preventing a press load variation of one press machine from acting on the other press machine.

SUMMARY OF THE INVENTION

In order to achieve the above-described object, according to the invention, there is provided a press angle control device for a press machine facility provided with a plurality of press machines constituting a press line, the press angle control device including: a reference value output unit which outputs a press angle reference value; and a press angle detection unit, a speed command unit, and a driving unit which are provided for each of the press machines, wherein the press angle detection unit detects a press angle of the corresponding press machine and outputs a press angle detection value, wherein the speed command unit outputs a command speed value to a motor of the corresponding press machine on the basis of the press angle reference value and the press angle detection value, wherein the driving unit controls a speed of the motor of the corresponding press machine on the basis of the command speed value, and wherein the press angle control device further comprises a correction unit which corrects the command speed value or the press angle reference value so that a difference between the press angle reference value and the press angle for each of the press machines is within a predetermined range.

According to the press angle control device for the press machine facility, the reference value output unit outputs the press angle reference value, the press angle detection unit detects the press angle of the corresponding press machine and outputs the press angle detection value, the speed command unit outputs the command speed value to the motor of the corresponding press machine on the basis of the press angle reference value and the press angle detection value, the driving unit controls a speed of the motor of the corresponding press machine on the basis of the command speed value, and the correction unit corrects the command speed value or the press angle reference value so that a difference between the press angle reference value and the actual press angle for each of the press machines is within a predetermined range, thereby reducing a difference (i.e., a press angle control error) caused by a press load variation.

Additionally, since the press angle reference value is independent from the press angle detection value of each press machine, the press angle reference value does not vary due to the press load variation. Also, since the press angle control is carried out on the basis of the press angle reference value, the press load variation of one press machine does not act on the other press machine.

According to the preferred embodiments of the invention, the correction unit corrects the command speed value or the press angle reference value so that a press angle difference between the adjacent press machines is within a predetermined range.

As described above, since the correction unit corrects the command speed value or the press angle reference value so that the press angle difference between the adjacent press machines is within a predetermined range, it is possible to reduce the press angle difference between the adjacent press machines and to perform a synchronization control or a phase difference control of the adjacent press machines.

According to the preferred embodiments of the invention, the correction unit corrects the command speed value or the press angle reference value so that the command speed value increases until a time point when a pressing process starts.

With such an operation of the correction unit, it is possible to efficiently reduce a difference between the press angle reference value and the press angle of the press machine. In general, since a press speed decreases due to the press load during a pressing process to thereby delay an advance of the press angle, a difference between the press angle reference value and the actual press angle tends to be maximum during the pressing process. According to the operation of the correction unit, since the command speed value or the press angle reference value is corrected so that the command speed value increases before the advance of the press angle is delayed due to the decrease of the press speed in accordance with the press load, it is possible to efficiently reduce a difference between the press angle reference value and the press angle during the pressing process, thereby reducing the maximum difference value.

According to the preferred embodiments of the invention, the correction unit corrects the command speed value or the press angle reference value so that the command speed value decreases after the pressing process starts.

With such a configuration, since the correction unit corrects the command speed value or the press angle reference value so that the command speed value decreases after the pressing process starts, it is possible to correct an excessive advance of the press angle due to the increase of the command speed value.

In order to achieve the above-described object, according to the invention, there is provided a press machine facility including: a plurality of press machines which constitutes a press line; and a press angle control device which controls press angles of the plurality of press machines, wherein the press angle control device includes: a reference value output unit which outputs a press angle reference value; and a press angle detection unit, a speed command unit, and a driving unit which are provided for each of the press machines, wherein the press angle detection unit detects a press angle of the corresponding press machine and outputs a press angle detection value, wherein the speed command unit outputs a command speed value to a motor of the corresponding press machine on the basis of the press angle reference value and the press angle detection value, wherein the driving unit controls a speed of the motor of the corresponding press machine on the basis of the command speed value, and wherein the press angle control device further comprises a correction unit which corrects the command speed value or the press angle reference value so that a difference between the press angle reference value and the press angle for each of the press machines is within a predetermined range.

According to the press machine facility, the reference value output unit outputs the press angle reference value, the press angle detection unit detects the press angle of the corresponding press machine and outputs the press angle detection value, the speed command unit outputs the command speed value to the motor of the corresponding press machine on the basis of the press angle reference value and the press angle detection value, the driving unit controls a speed of the motor of the corresponding press machine on the basis of the command speed value, and the correction unit corrects the command speed value or the press angle reference value so that a difference between the press angle reference value and the actual press angle for each of the press machines is within a predetermined range, thereby reducing a difference (i.e., a press angle control error) caused by a press load variation.

Additionally, since the press angle reference value is independent from the press angle detection value of each press machine, the press angle reference value does not vary due to the press load variation. Also, since the press angle control is carried out on the basis of the press angle reference value, the press load variation of one press machine does not act on the other press machine.

In order to achieve the above-described object, according to the invention, there is provided a press angle control method for a press machine facility provided with a plurality of press machines constituting a press line, wherein a reference value output unit outputs a press angle reference value, wherein in each of the press machines, a press angle detection unit detects a press angle of the press machine and outputs a press angle detection value, a speed command unit outputs a command speed value to a motor of the press machine on the basis of the press angle reference value and the press angle detection value, and a driving unit controls a speed of the motor of the press machine on the basis of the command speed value, and wherein a correction unit corrects the command speed value or the press angle reference value so that a difference between the press angle reference value and the press angle for each of the press machines is within a predetermined range.

According to the press angle control method for the press machine facility, the reference value output unit outputs the press angle reference value, in each of the press machines, the press angle detection unit detects the press angle of the corresponding press machine and outputs the press angle detection value, the speed command unit outputs the command speed value to the motor of the corresponding press machine on the basis of the press angle reference value and the press angle detection value, the driving unit controls a speed of the motor of the corresponding press machine on the basis of the command speed value, and the correction unit corrects the command speed value or the press angle reference value so that a difference between the press angle reference value and the actual press angle for each of the press machines is within a predetermined range, thereby reducing the difference (i.e., the press angle control error) caused by the press load variation or the press speed variation.

Additionally, since the press angle reference value is independent from the press angle detection value for each press machine, the press angle reference value does not vary due to the press load variation. Also, since the press angle control is carried out on the basis of the press angle reference value, the press load variation of one press machine does not act on the other press machine.

According to the preferred embodiments of the invention, in the above-described method, the correction unit corrects the command speed value or the press angle reference value so that a press angle difference between the adjacent press machines is within a predetermined range.

As described above, since the correction unit corrects the command speed value or the press angle reference value so that the press angle difference between the adjacent press machines is within a predetermined range, it is possible to reduce the press angle difference between the adjacent press machines and to perform a synchronization control or a phase difference control of the adjacent press machines.

According to the invention, it is possible to reduce the press angle control error caused by the press load variation and to prevent the press load variation of one press machine from acting on the other press machine.

DESCRIPTION OF THE PREFERRED EMBODIMENTS

Figure 1:
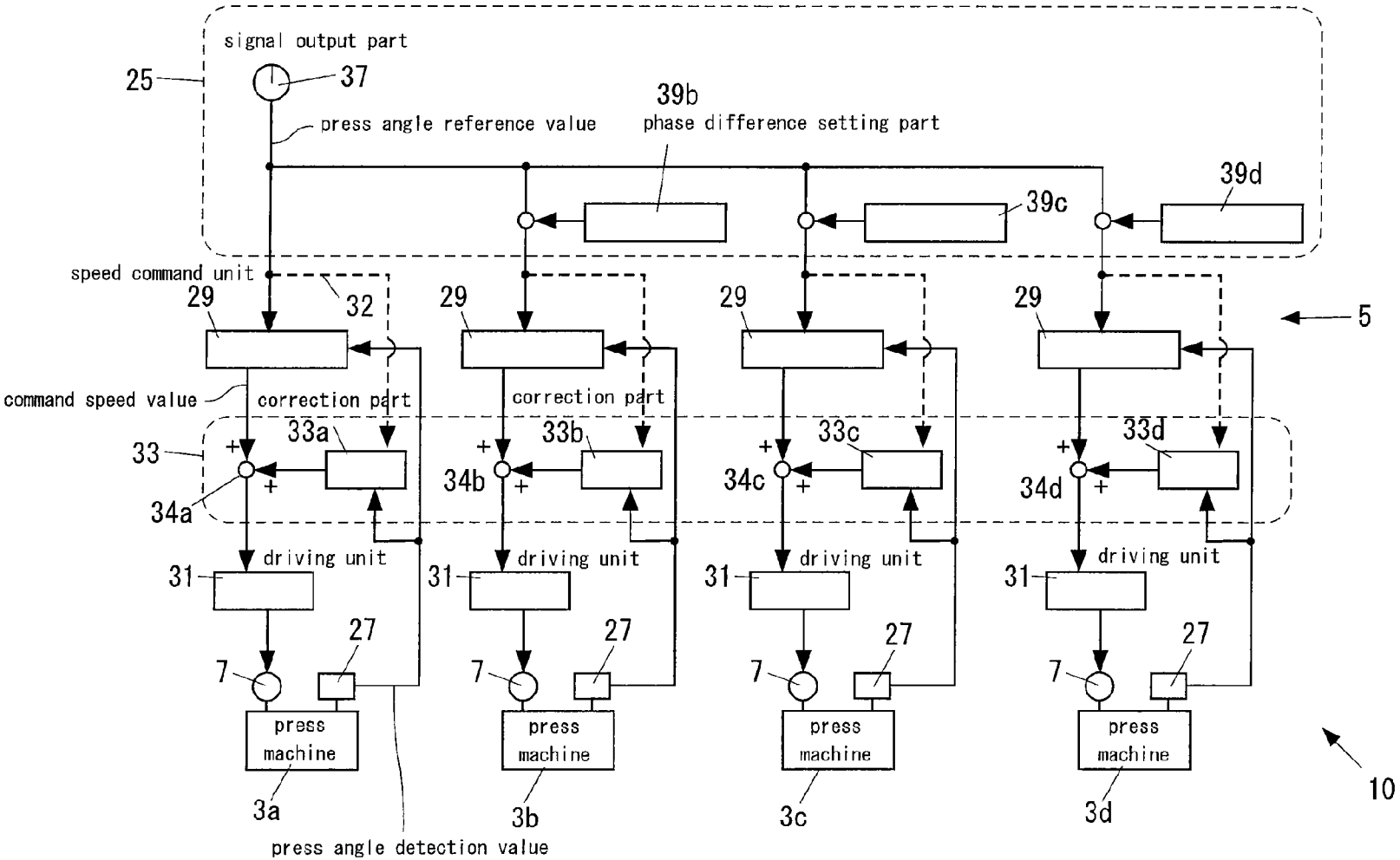
FIG. 1 is a configuration diagram showing a press machine facility according to a first embodiment of the invention.

Hereinafter, preferred embodiments of the invention will be described in detail with reference to the accompanying drawings. In addition, in the respective drawings, the same reference numerals are given to the same components and the repetitive description thereof will be omitted.

[First Embodiment]

FIG. 1 is a configuration diagram showing a press machine facility 10 according to an embodiment of the invention. The press machine facility 10 includes a plurality of press machines 3*a* to 3*d* and a press angle control device 5.

The plurality of press machines 3*a* to 3*d* (four units in this example) constitutes a press line. In the press line, a workpiece such as a panel is sequentially conveyed from the upstream press machine to the downstream press machine so that a pressing process is sequentially carried out by the press machines 3*a* to 3*d*. In this way, the pressing process is continuously carried out to efficiently produce the panel.

Figure 2:
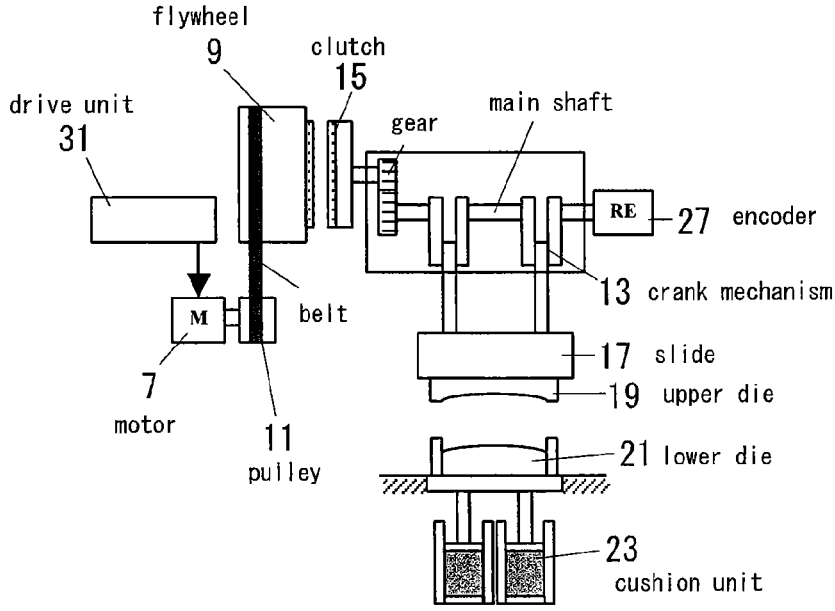
FIG. 2 is a configuration diagram showing each press machine.

Each of the press machines 3*a* to 3*d* has, for example, the configuration shown in FIG. 2.

As shown in FIG. 2, each of the press machines 3*a* to 3*d* includes a motor 7 for the pressing process, a flywheel 9 configured to be rotationally driven by the motor 7 so as to accumulate rotation energy, a pulley 11 configured to transmit a rotary driving force of the motor 7 to the flywheel 9, a crank mechanism 13 configured to receive the rotary driving force from the flywheel 9, a clutch 15 configured to connect or disconnect the flywheel 9 and the crank mechanism 13 to or from each other, a slide 17 configured to be connected to the crank mechanism 13, an upper die 19 configured to be attached to a lower surface of the slide 17, a lower die 21 configured to be provided below the upper die 19, and a cushion unit 23 configured to receive a press load.

With such a configuration, during the pressing process, the clutch 15 connects the flywheel 9 to the crank mechanism 13, and the crank mechanism 13 performs eccentric motion in terms of the rotary driving force generated from the motor 7, thereby performing the pressing process in such a manner that the slide 17 moves down by interposing the workpiece between the upper die 19 and the lower die 21. In addition, during the pressing process, the slide 17 moves up upon arriving at BDC (Bottom Dead Center), and moves down again upon arriving at TDC (Top Dead Center).

As shown in FIG. 1, the press angle control device 5 includes a reference value output unit 25, a correction unit 33, a press angle detection unit 27, a speed command unit 29, and a driving unit 31 provided for each press machine.

The reference value output unit 25 outputs a press angle reference value occasionally during the operation of the press machine facility 10. The press angle reference value is a reference value, independent from actual press angles of the press machines 3*a* to 3*d*. In addition, the press angle may be a rotary angle of a main shaft of the crank mechanism 13 (may vary in a range of 0 to 360 degree), and indicates an elevation position of the slide 17. That is, in order to perform the pressing process, the slide 17 continuously performs one-cycle motion in which the slide 17 moves down from a predetermined position (for example, TDC) to BDC and moves up again to return to the predetermined position. At this time, the press angle corresponds to the rotary angle (0 to 360 degree) of the main shaft of the crank mechanism 13, that is, the elevation position of the slide 17 during the one-cycle motion. In this example, the reference value output unit 25 outputs the press angle reference value so that the press angle increases at a predetermined rate in time, and continuously and periodically outputs the press angle in a range of 0 to 360 degree so that the press angle of 0 degree is output when the press angle reference value arrives at 360 degree.

In the example shown in FIG. 1, the reference value output unit 25 includes a signal output part 37, phase difference setting parts 39*b*, 39*c*, and 39*d*.

The signal output part 37 outputs the press angle reference value, and the phase difference setting parts 39*b*, 39*c*, and 39*d* correct the press angle reference value output from the signal output part 37 so as to have a predetermined phase difference. Subsequently, the corrected press angle reference value is output.

Between the press angle reference valve output from the signal output part 37 and the press angle reference valve corrected by the phase difference setting part 39*b*, a phase difference is maintained at constant valve.

During the operation of the press machine facility 10, each press angle detection unit 27 detects the press angle of the corresponding press machine occasionally, and outputs the detection value as a press angle detection value. In this example, each press angle detection unit 27 is an encoder which detects a rotary angle of the main shaft of the crank mechanism 13 and outputs the detection value as the press angle detection value. In addition, a resolver may be used instead of the encoder. Each press angle detection unit 27 may be configured as a unit other than the encoder or the resolver so long as the press angle is detected.

During the operation of the press machine facility 10, each speed command unit 29 outputs a command speed value to the motor 7 of the corresponding press machine occasionally on the basis of the press angle reference value and the press angle detection value. In this example, when there is no difference between the input press angle reference value and the input press angle detection value, each speed command unit 29 outputs a reference speed value obtained by differentiating the input press angle reference value in time as a command speed value. However, each speed command unit 29 outputs the same prior value at a time point when the press angle reference value varies from 360 degree to 0 degree. In this example, each speed command unit 29 outputs the predetermined command speed value.

In addition, when the input press angle reference value is larger than the input press angle detection value, each speed command unit 29 increases the reference speed value in accordance with a difference between the press angle reference value and the press angle detection value (for example, by an amount proportional to the difference), and outputs the corresponding increased command speed value.

Meanwhile, when the input press angle reference value is smaller than the input press angle detection value, each speed command unit 29 decreases the reference speed value in accordance with a difference between the press angle reference value and the press angle detection value (for example, by an amount proportional to the difference), and outputs the corresponding decreased command speed value.

During the operation of the press machine facility 10, each driving unit 31 controls a speed of the motor of the corresponding press machine occasionally on the basis of the command speed value. For example, each driving unit 31 controls the motor 7 so that a rotary speed of the motor 7 is equal to the input command speed value on the basis of a detection value detected by a detector (not shown) for detecting the rotary speed of the motor 7.

In the example shown in FIG. 1, the correction unit 33 includes correction parts 33*a* to 33*d* and adders 34*a* to 34*d* provided for each press machine. During the operation of the press machine facility 10, the correction unit 33 (i.e., the correction parts 33*a* to 33*d* and the adders 34*a* to 34*d*) controls the command speed value occasionally so that a difference between the press angle reference value and the actual press angle for each press machine is within a predetermined range. In this embodiment, the correction unit 33 (i.e., the correction parts 33*a* to 33*d* and the adders 34*a* to 34*d*) corrects the command speed value so that the command speed value increases until a time point when a pressing process starts while the slide 17 moves down.

In the example shown in FIG. 1, each of the correction parts 33*a* to 33*d* corrects the command speed value so that a difference between the press angle reference value and the press angle of the corresponding press machine is within a predetermined range on the basis of the press angle detection value, output from the press angle detection unit 27. Instead of the correction based on the press angle detection value, as depicted by a dashed arrow 32 in FIG. 1, each of the correction parts 33*a* to 33*d* may perform the correction on the basis of the press angle reference value, output from the reference value output unit 25.

Figure 3:
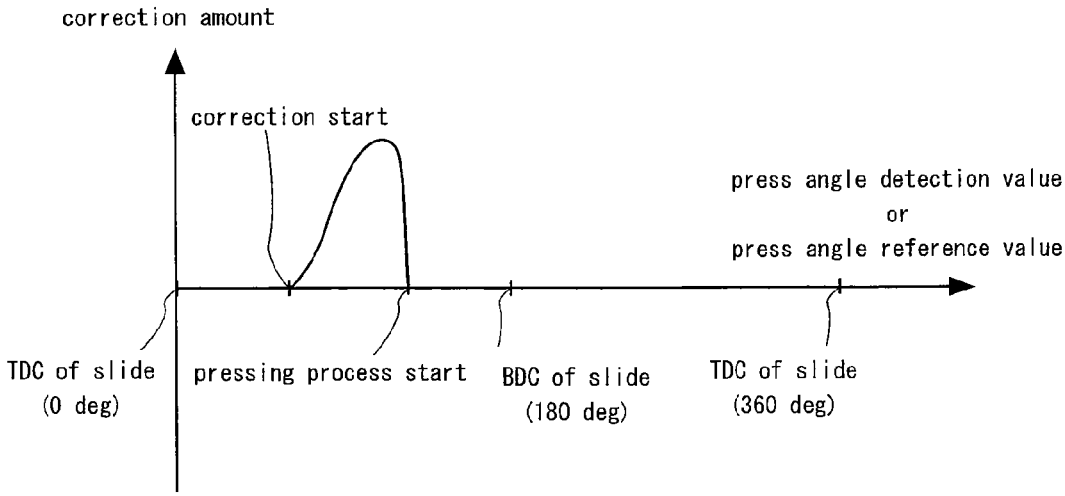
FIG. 3 is a graph showing a relationship between a correction amount and a press angle detection value or a press angle reference value.

Such a correction based on the press angle detection value or the press angle reference value may be carried out in a manner shown in a graph of FIG. 3. In the graph shown FIG. 3, a horizontal axis indicates the press angle detection value (the press angle reference value in a case of the correction based on the press angle reference value) input to each of the correction parts 33*a* to 33*d*, and a vertical axis indicates the correction amount added to the command speed value. In FIG. 3, the correction amount is 0 or a positive value before the pressing process starts after the slide is located at TDC, and again is equal to 0 after the pressing process starts. Specifically, in the example shown in FIG. 3, the correction amount gradually increases as a positive value until a time point just before the pressing process starts after a correction start time point when the press angle reference value or the press angle detection value input to each of the correction parts 33*a* to 33*d* is equal to a predetermined correction start value, and the correction amount decreases from a time point just before the pressing process starts and is equal to 0 at a time point when the pressing process starts.

Next, an operation of the press angle control device 5 will be described.

Figure 4:
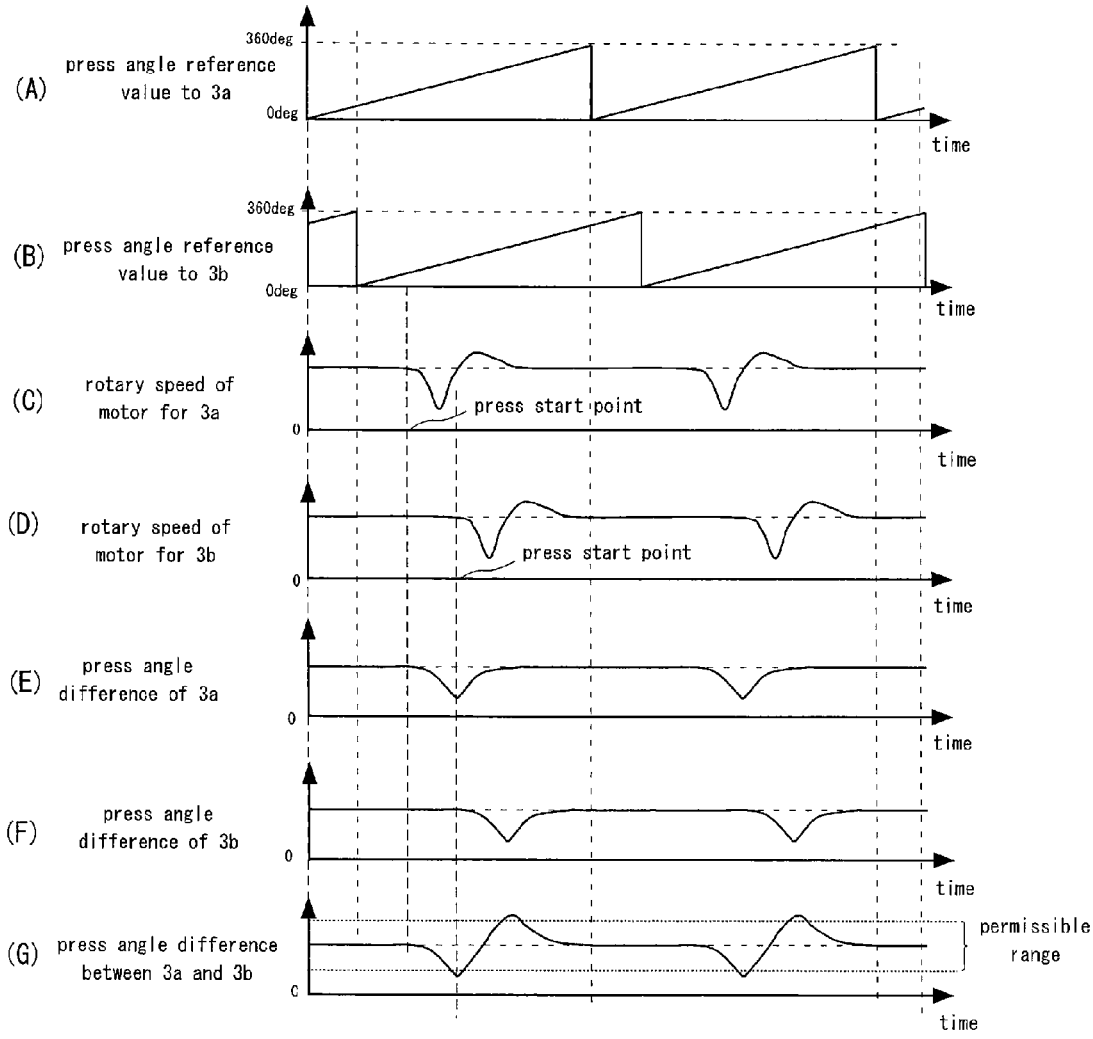
FIGS. 4A through 4G are graphs showing schematic operations of the press machine without a correction unit.
Figure 5:
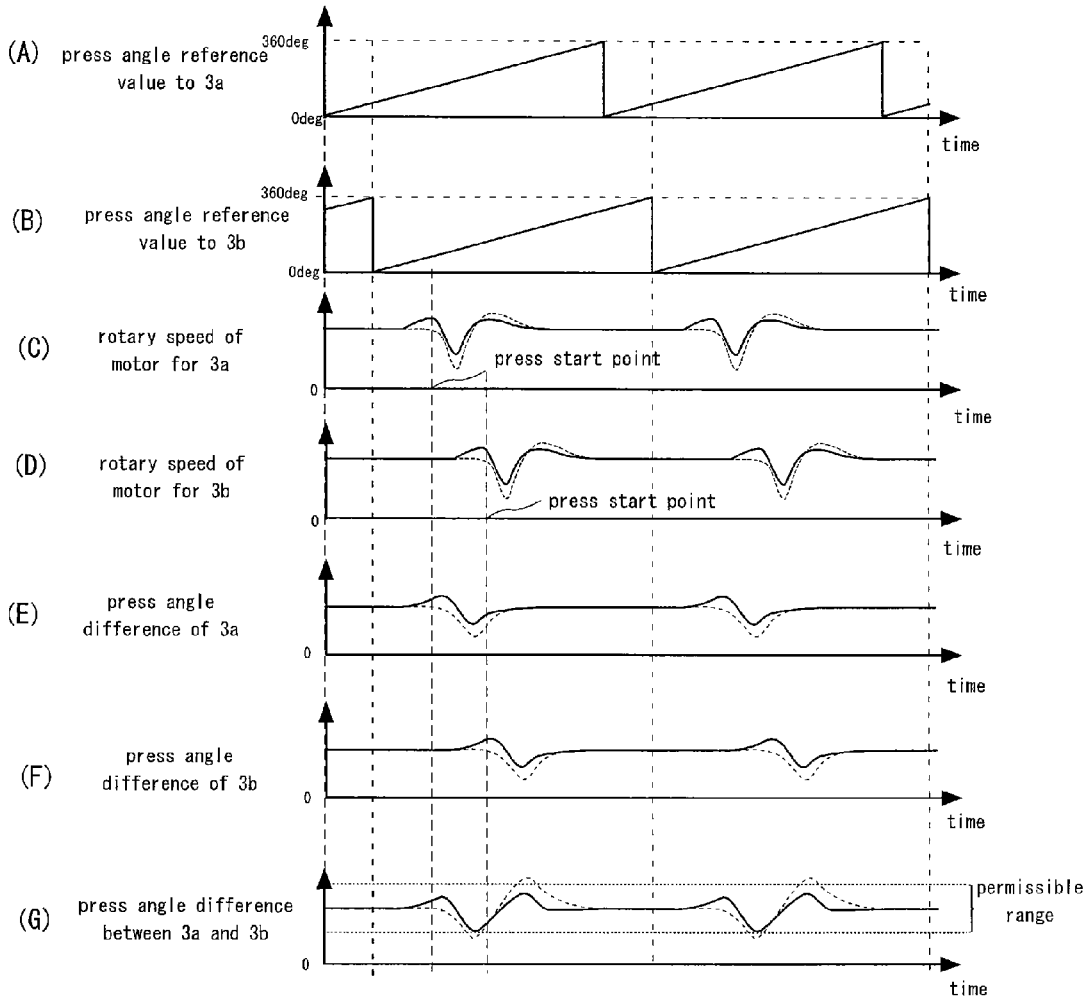
FIGS. 5A through 5G are graphs showing schematic operations of the press machine provided with the correction unit according to the first embodiment.

FIG. 4 shows a schematic operation of the press machine facility without the correction unit 33 shown in the configuration in FIG. 1. FIG. 5 shows a schematic operation of the press machine facility in FIG. 1.

In FIGS. 4 and 5, a horizontal axis indicates a time. Additionally, in FIGS. 4 and 5, a vertical axis in a graph (A) indicates the press angle reference value output from the reference value output unit 25 to the press machine 3*a*, a vertical axis in a graph (B) indicates the press angle reference value output from the reference value output unit 25 to the press machine 3*b*, a vertical axis in a graph (C) indicates a rotary speed of the motor 7 of the press machine 3*a*, a vertical axis in a graph (D) indicates a rotary speed of the motor 7 of the press machine 3*b*, a vertical axis in a graph (E) indicates a difference between the press angle reference value and the actual press angle of the press machine 3*a*, a vertical axis in a graph (F) indicates a difference between the press angle reference value and the actual press angle of the press machine 3*b*, and a vertical axis in a graph (G) indicates a difference between the actual press angle of the press machine 3*a* and the actual press angle of the press machine 3*b*.

In addition, in FIGS. 4 and 5, although the operations of the press machines 3*a* and 3*b* are illustrated, the operations of the press machine 3*c* and 3*d* are the same as those of the press machines 3*a* and 3*b* except that the operations of the press machines 3*c* and 3*d* have a predetermined phase different from that of the press machines 3*a* and 3*b*.

First, a case shown in FIG. 4 will be described. A cycle is repeated in which the press angle reference value output from the reference value output unit 25 increases at a predetermined rate in time from 0 to 360 degree. As shown in FIG. 4, in each of the press machines 3*a* to 3*d*, energy consumption is large during a pressing process time in which a press force of the upper die 19 acts on the workpiece, but energy consumption is comparatively small during a non-pressing process time in which the press force of the upper die 19 does not act on the workpiece. Accordingly, a press load variation (a torque variation of the motor 7) for one cycle becomes large.

In addition, although the large flywheel 9 is provided in the example shown in FIG. 2 in order to restrict a press load variation, a comparatively large press load variation occurs. Additionally, in the press machines 3*a* to 3*d* having such a flywheel 9, an inertia involved with rotating motion of the motor 7 increases in accordance with the large flywheel 9, thereby deteriorating a control of the motor speed.

In the graphs (C) and (D) shown in FIG. 4, a press speed (i.e., a rotary speed of the motor 7) decreases in some areas, which means that kinetic energy of the flywheel 9 reduces during the pressing process in which the press machines 3*a* to 3*d* press the workpiece. Since a difference between the press angle reference value and the press angle detection value increases due to the decrease of the press speed, as described above, the speed command unit 29 increases the command speed value on the basis of the difference, and outputs the increased command speed value. Accordingly, an advance delay of in the press angle is restored. In this case, since the rotary speed of the motor 7 largely decreases whenever energy transmitted from the flywheel 9 reduces, a control error of the press angle increases, and thus it is difficult to maintain a press angle difference among the press machines 3*a* to 3*d* to be within a predetermined range (a permissible range).

On the contrary, in this embodiment, an operation shown in FIG. 5 is carried out.

In FIG. 5, in graphs (C) to (G), the solid line indicates this embodiment provided with the correction unit, and the dashed line indicates a case without the correction unit for a comparison (i.e., a case shown in FIG. 4).

As shown in FIG. 5, the correction unit 33 performs a correction for increasing the command speed value input to the driving unit 31 in accordance with the correction amount shown in FIG. 3 before the reduction of the kinetic energy of a driving system (which includes the flywheel 9, the crank mechanism 13, and the slide 17) of the press machine 3*a*, 3*b*, 3*c* or 3*d*, that is, before the pressing process time in which the press force of the upper die acts on the workpiece. Accordingly, since the kinetic energy of the driving system temporarily increases, it is possible to restrict the decrease of the rotary speed of the motor 7 during the pressing process and to reduce the press angle difference among the press machines 3*a* to 3*d*, thereby maintaining the press angle difference within a predetermined range (a permissible range).

With the press machine facility 10 according to the invention, it is possible to obtain the following advantages (1) to (4).

(1) The reference value output unit 25 outputs the press angle reference value. Each press angle detection unit 27 detects the press angle of the corresponding press machine and outputs the press angle detection value. Each speed command unit 29 outputs the command speed value to the motor 7 of the corresponding press machine on the basis of the press angle reference value and the press angle detection value. Each driving unit 31 controls the motor speed of the corresponding press machine on the basis of the command speed value. The correction unit 33 corrects the command speed value so that a difference between the press angle reference value and the press angle for each of the press machines 3*a* to 3*d* is within a predetermined range. Accordingly, it is possible to restrict a difference caused by the press load variation (i.e., the press angle control error).

(2) Also, since the press angle reference value is independent from the press angle detection value for each of the press machines 3*a* to 3*d*, the press angle reference value does not vary due to the press load variation. Since the press angle control is carried out on the basis of such press angle reference value, the press load of one press machine cannot act on the other press machine.

(3) Also, since the correction unit 33 corrects the command speed value so that the command speed value increases until a time point when the pressing process starts, it is possible obtain the following advantages. In general, since the press speed decreases due to the press load during the pressing process to thereby delay the advance of the press angle, a difference between the press angle reference value and the actual press angle tends to be maximum during the pressing process. According to the operation of the correction unit 33, since the correction for increasing the command speed value is carried out before the advance of the press angle is delayed due to the decrease of the press speed in accordance with the press load, that is, before the pressing process starts, it is possible to efficiently reduce a difference between the press angle reference value and the press angle during the pressing process, thereby reducing the maximum difference value.

(4) Also, as described above, since each speed command unit 29 sets the reference speed value obtained by differentiating the input press angle reference value in time to the command speed value when there is no difference between the press angle reference value and the press angle detection value, even when the press production speed (i.e., an increase rate in time of the press angle reference value) varies during the pressing process, it is possible to automatically handle such a case, and thus to maintain the press angle difference between the press angle reference value and the press angle for each of the press machines 3*a* to 3*d* within a predetermined range.

[Second Embodiment]

Figure 6:
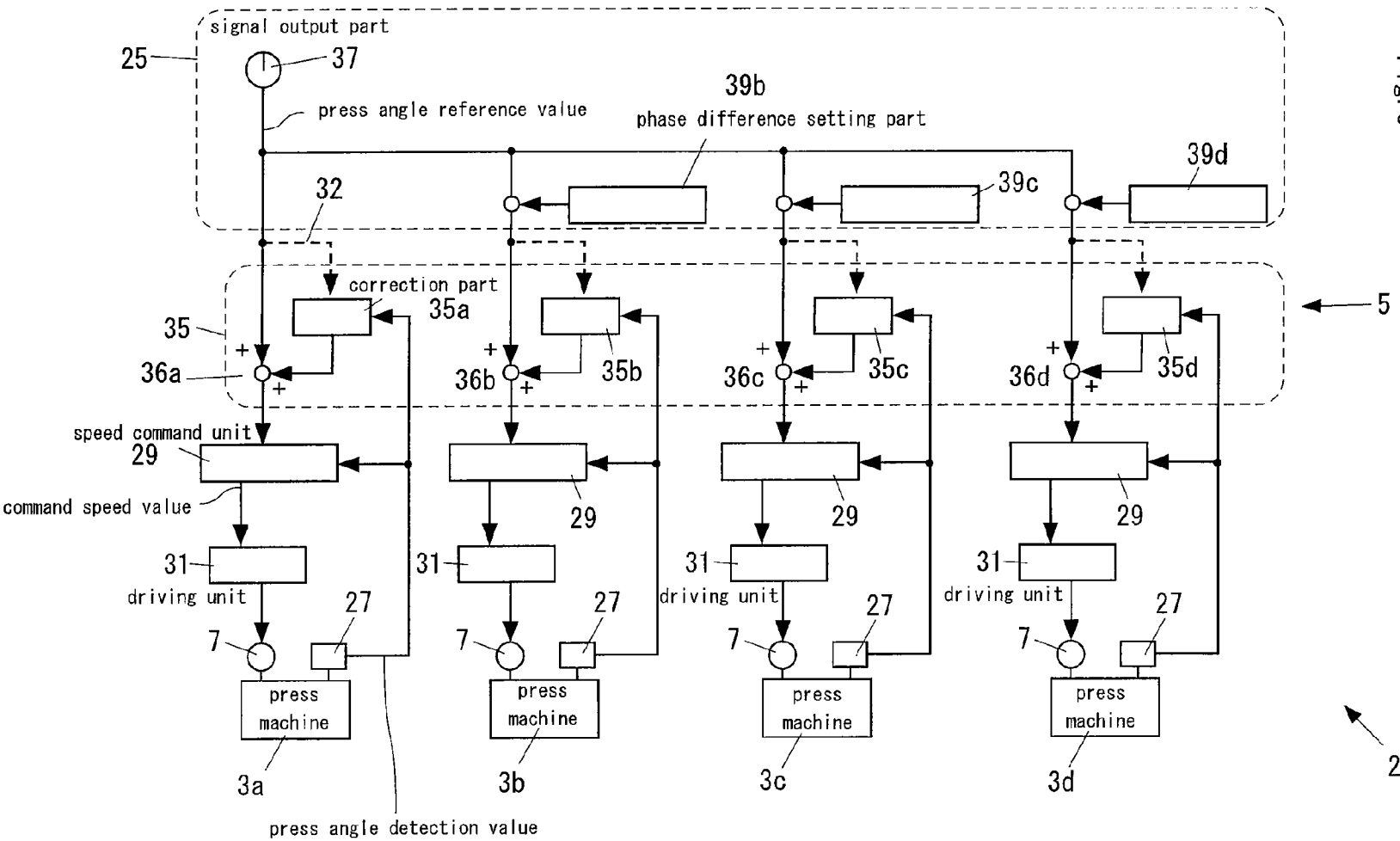
FIG. 6 is a configuration diagram showing the press machine facility according to the second embodiment of the invention.

FIG. 6 is a configuration diagram showing a press machine 20 according to the second embodiment of the invention. A configuration of the second embodiment is the same as that of the first embodiment except for the correction unit.

In the second embodiment, as shown in FIG. 6, a correction unit 35 includes correction parts 35*a* to 35*d* and adders 36*a* to 36*d* provided for each press machine. During the operation of the press machine facility 20, the correction unit 35 (i.e., the correction parts 35*a* to 35*d* and the adders 36*a* toe 36*d*) controls the press angle reference value output from the reference value output unit 25 (i.e., the signal output part 37 or the phase difference setting parts 39*b*, 39*c*, and 39*d*) occasionally so that a difference between the press angle reference value and the press angle of the press machines 3*a* to 3*d* is within a predetermined range. In this embodiment, the correction unit 35 (i.e., the correction parts 35*a* to 35*d* and the adders 36*a* to 36*d*) corrects the press angle reference value so that the command speed value increases until a time point when the pressing process starts while the slide 17 moves down. That is, the press angle reference value increases.

In the example shown in FIG. 6, each of the correction parts 35*a* to 35*d* corrects the press angle reference value so that a difference between the press angle reference value and the press angle of the corresponding press machine is within a predetermined range on the basis of the press angle detection value, corresponding to a reference such as a correction start time point, output from the press angle detection unit 27. Instead of the correction based on the press angle detection value, as depicted by the dashed arrow 32 in FIG. 6, each of the correction parts 35*a* to 35*d* may perform the correction on the basis of the press angle reference value, corresponding to a reference such as a correction start time point, output from the reference value output unit 25. The correction amount of the reference press angle corrected by the correction parts 35*a* to 35*d* may be the same as that of the first embodiment or may be the correction amount shown in the graph of FIG. 3.

In the press machine facility 20 according to the second embodiment, it is possible to obtain the same advantage as that of the first embodiment.

[Other Embodiments]

The present invention is not limited to the above-described embodiments, but may be, of course, modified into various forms without departing from the scope of the invention.

For example, in the first and second embodiments, although it has been described about a case in which the press machine facility is operated by the phase difference control for maintaining the press angle difference among the plurality of press machines 3*a* to 3*d* within a predetermined range, the invention is not limited thereto. That is, in the first and second embodiments, the press machine facility may be operated by a synchronous control for maintaining the press angle difference among the plurality of press machines 3*a* to 3*d* to be 0. In this case, the phase difference setting parts 39*b*, 39*c*, and 39*d* shown in FIGS. 1 and 6 are omitted, and thus the same press angle reference value is input to the press machines 3*a* to 3*d*. Also, in this case, other configurations and operations are the same as those of the first and second embodiments.

In the first or second embodiment, the correction unit 33 (i.e., the correction parts 33*a* to 33*d* and the adders 34*a* to 34*d*) or the correction unit 35 (i.e., the correction parts 35*a* to 35*d* and the adders 36*a* to 36*d*) may correct the command speed value or the press angle reference value so that the command speed value decreases after a time point when the pressing process starts. Accordingly, in a case where the press angle is excessively advanced by the correction for increasing the command speed value, it is possible to correct the excessive advance of the press angle.

Figure 7:
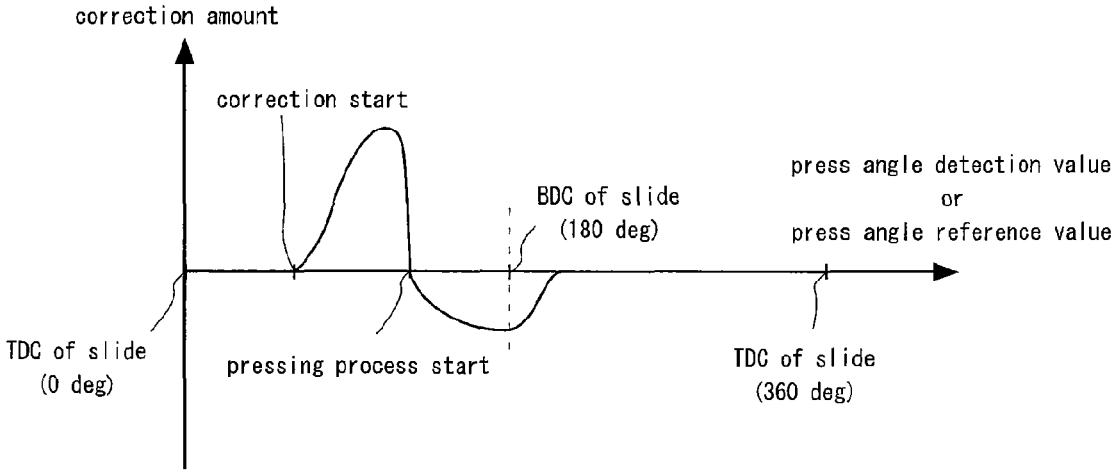
FIG. 7 is a graph showing another relationship between the correction amount and the press angle detection value or the press angle reference value.

In this case, the correction amount of the correction unit 33 (i.e., the correction parts 33*a* to 33*d*) or the correction unit 35 (i.e., the correction parts 35*a* to 35*d*) may be that shown in FIG. 7 instead of FIG. 3. In the graph shown in FIG. 7, a horizontal axis indicates the press angle detection value input to the correction parts 33*a* to 33*d* or the correction parts 35*a* to 35*d* (the press angle reference value in a case of the correction based on the press angle reference value), and a vertical axis indicates the correction amount of the correction unit 33 or 35 added to the press angle reference value or the command speed value. In FIG. 7, the correction amount is 0 or a positive value until a time point before the pressing process starts after the slide is located at TDC, and is a negative value or 0 after the pressing process starts.

Specifically, in the example shown in FIG. 7, the correction amount gradually increases from a positive value until a time point just before the pressing process starts after a correction start time point when the press angle reference value or the press angle detection value input to each of the correction parts 33*a* to 33*d* or the correction parts 35*a* to 35*d* is equal to a predetermined correction start value, and the correction amount decreases from a time point just before the pressing process starts and is equal to 0 at a time point when the pressing process starts. Subsequently, the correction amount gradually increases from a negative value until a time point when the press angle reference value or the press angle detection value input to each of the correction parts 33*a* to 33*d* or each of the correction parts 35*a* to 35*d* is equal to 180 degree (BDC of the slide). Subsequently, the correction amount gradually decreases until a correction end time point when the press angle reference value or the press angle detection value input to each of the correction parts 33*a* to 33*d* or the correction parts 35*a* to 35*d* is equal to a predetermined correction end value.

In this case, other configurations may be the same as those of the first and second embodiments.

Also, in the first and second embodiments, the flywheel 9 is used, but the flywheel 9 may be omitted. That is, the invention may be applied to the press machine facility provided with a plurality of press machines 3*a* to 3*d* without the flywheel 9.

Also, the speed command unit 29 may be configured as a unit for performing a PI control of a speed of the motor 7 on the basis of the input press angle reference value and the press angle detection value.

What is claimed is:

1. A press angle control device for a press machine facility provided with a plurality of press machines constituting a press line, the press angle control device comprising:

(a) a reference value output unit which outputs a press angle reference value;

(b) a plurality of press angle detection units;

(c) a plurality of speed command units;

(d) a plurality of driving units, wherein one press angle detection unit, one speed command unit and one driving unit are provided for each of the press machines, wherein the press angle detection unit detects a press angle of the corresponding press machine and outputs a press angle detection value, wherein the speed command unit outputs a command speed value to a motor of the corresponding press machine on the basis of the press angle reference value and the press angle detection value, wherein the driving unit controls a speed of the motor of the corresponding press machine on the basis of the command speed value; and (e) a correction unit that corrects the command speed value or the press angle reference value so that a difference between the press angle reference value and the press angle for each of the press machines is within a predetermined range, and wherein the correction unit corrects the command speed value or the press angle reference value so that the command speed value increases until a time point when a pressing process starts.

2. The press angle control device according to claim 1, wherein the correction unit corrects the command speed value or the press angle reference value so that a press angle difference between the adjacent press machines is within a predetermined range.

3. The press angle control device according to claim 1, wherein the correction unit corrects the command speed value or the press angle reference value so that the command speed value decreases after the pressing process starts.

4. A press machine facility comprising:

(a) a plurality of press machines, wherein the plurality of press machines constitute a press line, wherein each press machine has a press angle; and (b) a press angle control device that controls the press angles of the plurality of press machines, wherein the press angle control device includes (i) a reference value output unit that outputs a press angle reference value;

(ii) a plurality of press angle detection units;

(iii) a plurality of speed command units; and (iv) a plurality of driving units, wherein one press angle detection unit, one speed command unit, and one driving unit are provided for each of the press machines, wherein the press angle detection unit detects the press angle of the corresponding press machine and outputs a press angle detection value, wherein the speed command unit outputs a command speed value to a motor of the corresponding press machine on the basis of the press angle reference value and the press angle detection value, wherein the driving unit controls a speed of the motor of the corresponding press machine on the basis of the command speed value; and (e) a correction unit that corrects the command speed value or the press angle reference value so that a difference between the press angle reference value and the press angle for each of the press machines is within a predetermined range, and wherein the correction unit corrects the command speed value or the press angle reference value so that the command speed value increases until a time point when a pressing process starts.

5. A press angle control method for a press machine facility provided with a plurality of press machines constituting a press line, the method comprising the steps of:

(a) outputting a press angle reference value from a reference value output unit, (b) detecting a press angle of a corresponding press machine, (c) outputting a press angle detection value, wherein a press angle detection unit detects the press angle of the corresponding press machine and outputs the press angle detection value, (d) outputting a command speed value to a motor of the press machine on the basis of the press angle reference value and the press angle detection value, wherein the command speed value is outputted by a speed command unit, (e) controlling a speed of the motor of the press machine on the basis of the command speed value, wherein the speed of the motor of the press machine is controlled by a driving unit; and (f) correcting the command speed value or the press angle reference value so that a difference between the press angle reference value and the press angle for each of the press machines is within a predetermined range, wherein the command speed value and the press angle reference value are corrected by a correction unit, and wherein the correction unit corrects the command speed value or the press angle reference value so that the command speed value increases until a time point when a pressing process starts.

6. The press angle control method according to claim 5, wherein the correction unit corrects the command speed value or the press angle reference value so that a press angle difference between the adjacent press machines is within a predetermined range.

7. The press angle control device according to claim 2, wherein the correction unit corrects the command speed value or the press angle reference value so that the command speed value decreases after the pressing process starts.

* * * * *